United States Patent [19]

Linkroum

[11] 4,027,198

[45] May 31, 1977

[54] CAPACITOR DISCHARGE IGNITION SYSTEM

[75] Inventor: Irving E. Linkroum, Hancock, N.Y.

[73] Assignee: The Bendix Corporation, Southfield, Mich.

[22] Filed: Aug. 14, 1975

[21] Appl. No.: 604,687

[52] U.S. Cl. ..... 315/209 CD; 315/209 R; 315/247; 315/278; 315/279; 123/148 E; 315/241 R

[51] Int. Cl.[2] ..... H05B 37/02; H05B 39/04; H05B 41/36

[58] Field of Search ..... 315/209 CD, 209 SC, 315/241 R, 227 R, 276, 277, 278, 247, 279; 123/148

[56] References Cited

UNITED STATES PATENTS

| | | | |
|---|---|---|---|
| 2,473,917 | 6/1949 | Steinert et al. | 315/247 X |
| 2,791,726 | 5/1957 | Feinberg | 315/276 |
| 2,864,035 | 12/1958 | Davis | 315/278 |
| 3,080,505 | 3/1963 | Eppert | 315/277 |
| 3,427,501 | 2/1969 | Laub et al. | 315/227 R |
| 3,450,972 | 6/1969 | Linkroum | 315/241 R |
| 3,780,347 | 12/1973 | Riesland | 315/247 X |
| 3,890,562 | 6/1975 | West | 315/247 X |

*Primary Examiner*—Saxfield Chatmon, Jr.

*Attorney, Agent, or Firm*—Raymond J. Eifler; Kenneth A. Seaman

[57] ABSTRACT

A capacitor discharge ignition system for a jet engine which has a relatively high power factor at the transformer input without exceeding the one ampere current rating required in jet ignition systems at the desired power level. A specially designed power transformer (10 ) has a capacitor (3) connected across closely coupled primary and tertiary windings (11 and 12).

9 Claims, 1 Drawing Figure

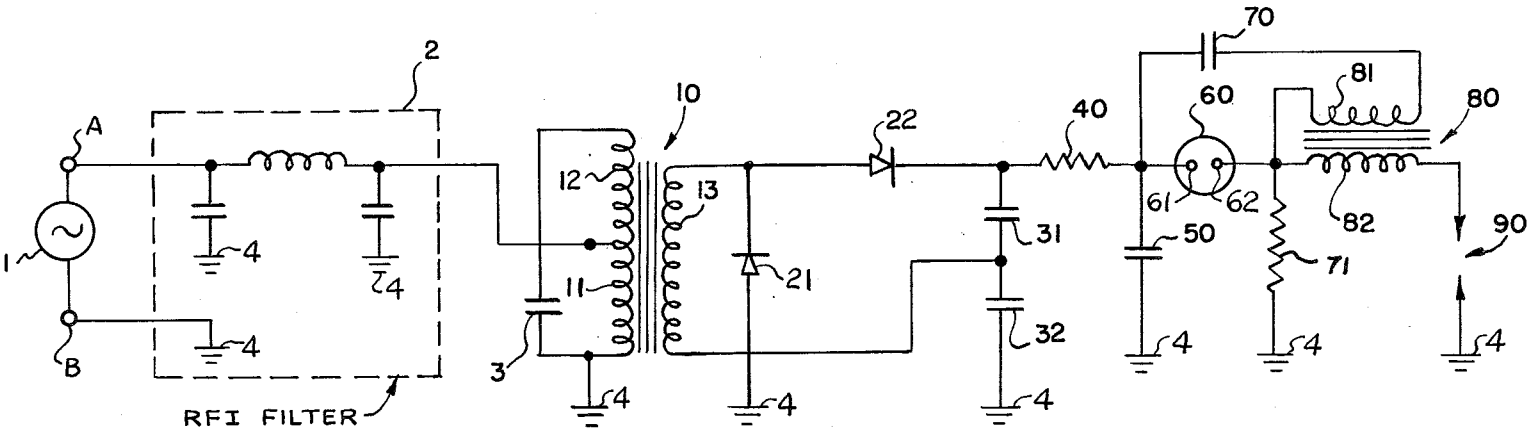
RFI FILTER
A
B
1
2
3
4
10
11
12
13
21
22
31
32
40
50
60
61
62
70
71
80
81
82
90

CAPACITOR DISCHARGE IGNITION SYSTEM

BACKGROUND OF THE INVENTION

This invention relates to a capacitor discharge ignition system that is especially useful for jet engines. The invention is more particularly related to power factor correction of the AC input circuit of a capacitor discharge ignition system.

Jet engines require an ignition system that continuously causes a spark (2 per second) at a spark plug during the operation of the jet engine. The continuous spark assures that the fuel will remain ignited. It is a requirement of an ignition system for a jet engine that an electrical discharge, of a predetermined amount of energy, occur at the plug at the specified rate so as to assure combustion of the fuel. Therefore, one reason why combustion does not occur is that there is insufficient electrical energy in the electrical discharge to cause combustion of the fuel in the jet engine. Because of space limitations, weight limitations and electrical wiring limitations, jet engine manufacturers generally limit the size of the ignition system as well as the current that may flow into a circuit at a particular power level which requires certain minimum energy levels. The space and weight limitations are obviously necessary because the more weight added to an aircraft the larger the engine must be. Similarly, the more current that flows through conductors the larger the cabling and, hence, the weight of the cables.

Certain jet engines require a capacitor discharge ignition system that must store nine joules of energy in a storage capacitor while the AC input current to a transformer in the circuit must be equal to or less than 1 AMP. To limit the AC current in the circuit, some transformers utilize the inductive decoupling between the primary and the secondary windings to provide an input for the purpose of limiting the current in the primary windings of the transformer. The foregoing type transformer also causes a lagging power factor, i.e., the current reaches its peak value after the voltage reaches its peak value. Therefore, in the foregoing type of system there is a reduced power factor. This is a disadvantage because the current required to power such a system must be increased to obtain the same amount of output power as a system without a lagging power factor. This problem led to the search of a power factor correction circuit that would increase the power factor of such a circuit by decreasing the lag between current and voltage peaks. The most obvious solution to correcting a power factor is to place a capacitor across the primary winding of the transformer. However, the efficiency of low voltage capacitors (110 volts) is poor and in situations where capacitors are designed for operating in a high ambient temperature the capacitor would be physically large and, therefore, unacceptable in size and weight to the jet engine manufacturer.

Therefore, the specific problem presented to the inventor was to provide a 110 volt input capacitor discharge ignition system having nine joules of energy stored in a capacitor each time it was periodically discharged while limiting the input current to less then one AMP. Thus, since the capacitor was to be charged and discharged two times per second and since size and weight were to be minimized, that posed a difficult problem.

SUMMARY OF THE INVENTION

This invention provides a capacitor discharge ignition system for jet engines that reduces the lag between voltage and current peaks so that the power factor of the circuit is increased.

The capacitor discharge ignition system that accomplishes this result is characterized by input circuitry that includes a transformer 10 that has a primary winding 11 and a tertiary winding 12 closely coupled so as to constitute an auto transformer connection. A capacitor 3 is then connected across the primary and tertiary windings while the input power is connected only across the primary winding 11. Thus, for a given power factor, a capacitor can be used which is smaller in capacitance and size than a capacitor in a circuit without such tertiary winding arrangement. This saves space and weight while achieving the desired current input limitations specified by the engine's manufacturer. Accordingly, it is an object of this invention to increase the power factor at the AC input of the capacitor discharge ignition system in a manner that allows the maximum current at a desired power level to remain below a predetermined value.

Another object of this invention is to provide an improved electrical system for generating spark discharges.

Another object of this invention is to provide a capacitor discharge ignition system having an improved power factor by the addition of a capacitor that is physically smaller than would normally be expected.

Another object of this invention is to reduce the lagging power factor in the AC input circuit of a capacitor discharge ignition system.

DETAILED DESCRIPTION OF THE DRAWING

The ignition system shown in the single FIGURE is of the capacitor discharge type which is energized by a suitable source 1 of alternating electric current or a source of interrupted direct current connected to input terminals A and B of the ignition circuit.

The current source is connected to the primary winding 11 of a power transformer 10 having a tertiary winding 12 and a secondary winding 13. Connected across the primary and tertiary windings 11 and 12 of the transformer 10 is a capacitor 3.

Normally, the power factor of certain transformers having a lagging power factor can be corrected by placing a capacitor across the primary winding of the transformer. However, the input voltage value of such a transformer is usually 115 volts and low voltage capacitors, which are designed for operation in high ambient temperatures, are generally physically large in size. In the circuit shown the power factor can be corrected by a capacitor 3 of a much smaller physical size. The size of the capacitor depends on the turns ratio between the primary winding 11 and the tertiary winding 12 of the transformer. Therefore, in cases such as in aircraft, where a high power factor is required but limited space is available, a high power factor can be obtained by the transformer and capacitor shown in the single FIGURE. The inventor has found that if tertiary winding 12 has the same number of turns as primary winding 11, capacitor 3 would produce the same power factor as a capacitor in a similar circuit where the capacitor was across a transformer having only a primary winding except that such a capacitor would have a capacitance four times as large as the capacitance of capacitor 3 used in the circuit shown. The following equation illustrates the foregoing advantage:

$$X = \left(\frac{N1 + N2}{N1}\right)^2$$

N1 = the number of turns of primary winding 11
N2 = the number of turns of tertiary winding 12
X = the number by which the capacitance of a capacitor in a capacitor discharge ignition system having a tertiary winding transformer is divided to obtain the capacitive value of a capacitor in the inventor's circuit which will produce the same amount of electrical energy at the secondary winding of the transformer in the inventor's circuit as the other circuit.

Thus, for a given power factor, a smaller capacitor may be used with this circuit as opposed to a circuit wherein the transformer has only a primary winding with a capacitor across the primary winding. Accordingly, the space saving advantage as well as the weight saving advantage afforded by this approach may be realized.

Included in the primary portion of the circuit is a radio frequency-filtering circuit 2 to attenuate high-frequency noise generated within the ignition circuit and, thus, prevent interference from being transmitted to other portions of the circuit.

A voltage doubler circuit is connected across the secondary winding 13 of the transformer 10. The voltage doubler circuit includes diodes 21 and 22 and capacitors 31 and 32. The capacitor 31 is connected across winding 13 of the transformer through the diode or half wave rectifier 22 so that the capacitor 31 is charged on the positive portion of the charging cycle while capacitor 32 is charged on the negative portion of the charging cycle. This arrangement provides a voltage across capacitor 31 and 32 double the voltage across the output winding 13 of the transformer 10. Both capacitors 31 and 32 are connected across a capacitor 50 which has a relatively large capacitance. The storage capacitor 50 is periodically discharged to a pulse absorbing load such as an igniter plug or spark gap 90. When the diodes 21 and 22 are connected, as shown, and the capacitors 31 and 32 are charged, capacitor 50 is capable of storing energy equal to $\frac{1}{2} CV^2$; where V is the voltage across the capacitor 50. The diodes 21 and 22 may be protected against damage, the operating life thereof may be enhanced, and the required rating thereof may be minimized by providing current limiting resistor 40. One side of the capacitor 50 shown is connected to a common ground 4. It is understood that, if desired, all of the ground points may be connected together by a common ungrounded conductor. The input electrode 61 of the control gap 60 is connected to the high potential side of the main storage capacitor 50; the output electrode 62 of the control gap 60 is connected to one terminal of the secondary winding 82 of a step-up transformer 80, while the other terminal of the secondary winding 82 is connected to the ungrounded electrode of the spark plug 90.

Connected across the electrode 61 annd 62 of the control gap 60 is a circuit having a small capacitor 70 connected in series with the primary winding 81 of the transformer 80. A resistor 71 completes the path for charging capacitor 70 as well as providing a path for the discharge of capacitor 50 in the event that igniter plug 90 fails to spark.

The discharge circuit of the storage capacitor 50 includes: a control gap; a resistor 71; a transformer 80; a capacitor 70; and an ignition plug or spark plug 90. The transformer 80 generally has a very high turns ratio so that when capacitor 70 discharges through primary winding 81 an extremely high voltage of about 15 to 20 thousand volts is impressed across the secondary and, hence, the igniter plug 90. The igniter plug 90 includes two electrodes across which an electrical arc would discharge if initiated and which receives and discharges the energy from capacitor 50 when it discharges through the control gap 60.

Since this ignition system is an untimed ignition system (as opposed to a timed ignition system for an automobile engine) the control gap 60 is a switching device selectively rendered conductive and nonconductive. The control gap 60 includes two electrodes that are designed to break down when a specific voltage is impressed across the electrodes. Therefore, each time capacitor 50 reaches this predetermined voltage, control gap 60 breaks down allowing the energy stored in capacitor 50 to discharge through the control gap 60.

OPERATION

In one embodiment of the capacitor discharge type ignition circuit the power transformer 10 steps up the supply voltage, (e.g. 400 cycle, 115 volts) to a level in excess of 1,800 volts peak at the secondary winding 13 of the transformer. Each half cycle of the supply voltage is rectified by diodes 21 and 22 respectively to charge the doubler capacitors 31 and 32 respectively. The voltage across capacitors 31 and 32 is additive and, therefore, the voltage charging the main storage capacitor 50 is in excess of 3,600 volts peak.

Storage capacitor 50 continues to charge until it reaches a voltage which is equal to the breakdown voltage of the control gap 60. As soon as the voltage across the control gap 60 exceeds its ionization potential (e.g. 3,550 volts), the control gap 60 is rendered conductive. When this occurs, trigger capacitor 70 discharges through the primary winding 81 of the transformer 80 resulting in a stepped-up voltage across the secondary winding 82 of the transformer 80. The stepped-up voltage is in the order of 15 to 20 kilo volts which is also impressed across the spark plug 90 to initiate an arc across the gap of the spark plug 90. Simultaneously, with the initiation of the arc across the gap of the spark plug 90, the energy contained in storage capacitor 50 is discharged through the control gap 60, the secondary winding 82 of the transformer and through the gap in the spark plug 90. This energy from the large storage capacitor 50 is termed "follow through" energy. After the voltage across the capacitor 50 decreases to a low value, the voltage across the electrodes 61 and 62 of the control gap decreases so that the control gap 60 deionizes and becomes nonconductive (turns off) so that the cycle may repeat itself.

Typical values of component parts which make up the above described system are as follows:

| COMPONENTS | | VALUE |
|---|---|---|
| capacitor | 3 | .7 microfarads |
| capacitor | 31 | .06 microfarads |
| capacitor | 32 | .06 microfarads |
| capacitor | 70 | .06 microfarads |
| capacitor | 50 | 2.0 microfarads |

-continued

| COMPONENTS | | VALUE |
|---|---|---|
| resistor | 40 | 1K ohms |
| resistor | 71 | 600 ohms |
| control gap | 60 | ionization potential volts |
| transformer | 80 | primary/secondary turns ratio 4/20 |
| transformer | 10 | primary/tertiary/secondary 400/400/11,000 |
| igniter | 90 | Bendix Electrical Components Division Part No. 10-390525-1 |

Although only a single embodiment of the invention has been illustrated as described in the foregoing specification, it is to be expressly understood that the invention is not limited thereto but may be embodied in specifically different circuits. For example, the main tank or storage capacitor 50 may be charged by means other than the voltage doubling system shown. For example, such capacitor may be charged directly from the secondary winding of a step-up transformer powered by an alternating current source. Thus, the transformer may also be powered by an interrupted direct current source. Various other changes may also be made, such as in the electrical values suggested herein by way of example, and in the types of rectifiers illustrated without the parting from the spirit and scope of the invention, as will now be apparent to those skilled in the art.

What is claimed is:

1. A capacitor discharge ignition system for igniting fuel in a jet engine comprising:

a transformer having a secondary winding, a primary winding for receiving alternating electric current, and a tertiary winding in series with the primary winding;

a first capacitor electrically connected across the primary and tertiary windings of said transformer;

a second capacitor;

means for rectifying the alternating electric current received from the secondary windings of said transformer and supplying such rectified current to the second capacitor; and means for periodically discharging the electrical energy stored in said second capacitor, including:

a switching device periodically rendered electrically conductive and electrically nonconductive, said switching device permitting said second capacitor to discharge when conductive and preventing said second capacitor from discharging when electrically nonconducting;

a second transformer having a first winding and a second winding, with said first winding coupled to said switching device; and a discharge device coupled in series with the second transformer for dissipating the electrical energy from said second capacitor when said switching device is rendered electrically conductive, said discharge device located within the jet engine for igniting fuel therein, whereby the discharge of the second capacitor through the switching device causes igniting of the fuel in the jet engine.

2. A capacitor discharge ignition system as recited in claim 1 wherein said means for periodically discharging the electrical energy stored in said second capacitor further includes:

a third capacitor; and wherein said second winding of the second transformer and said third capacitor are connected in series with each other and across said switching device, and said first winding is electrically connected to receive the discharge from said second capacitor when said switching device is rendered conductive; and wherein the discharge device is a spark plug having spaced electrodes electrically connected in series with said first winding, whereby when said switching device conducts said third capacitor discharges through the second winding of said second transformer causing an electrical discharge of energy to occur between the electrodes of said spark plug, allowing the second capacitor to discharge through the first winding of said second transformer and across the electrodes of said spark plug.

3. An ignition system for periodically igniting fuel in a jet engine, said system comprising:

a transformer having a primary winding for receiving electrical energy, a tertiary winding in series with the primary winding and a secondary winding electromagnetically coupled to said primary and tertiary windings;

a capacitor connected across the primary and tertiary windings of said transformer;

means for storing electrical energy received from the secondary winding of said transformer; and means for periodically discharging the electrical energy stored in the means for storing electrical energy, including a switching device selectively rendered electrically conductive and electrically nonconductive, said switching device permitting said energy storage device to discharge its stored energy when conductive and preventing said energy storage device from discharging its stored energy when electrically nonconductive;

a second transformer having a primary winding and a secondary winding and coupled to said switching device; and a discharge device coupled in series with the secondary winding for dissipating electrical energy from said second capacitor when said switching device is conductive, said discharge device loacated within the jet engine for igniting fuel therein, whereby said energy storing device periodically discharges its stored energy through the switching device to cause igniting of the fuel in the jet engine.

4. An ignition system as recited in claim 3 wherein said discharge device includes:

a spark plug having spaced electrodes, said spark plug adapted to receive and dissipate the energy discharged from said energy storage means across the spaced electrodes of said spark plug.

5. An ignition system as recited in claim 4 wherein said means for periodically discharging the electrical energy stored in the means for storing electrical energy includes:

means for periodically rendering said switching device electrically conductive and electrically nonconductive.

6. The capacitor discharge ignition system as recited in claim 1 wherein the primary winding and the tertiary winding of said transformer have the same number of turns.

7. The capacitor discharge ignition system as recited in claim 2 wherein the primary winding and the tertiary winding of said transformer have the same number of turns.

8. The capacitor discharge ignition system as recited in claim 3 wherein the primary winding and the tertiary winding of said transformer have the same number of turns.

9. The capacitor discharge ignition system as recited in claim 4 wherein the primary winding and the tertiary winding of said transformer have the same number of turns.

* * * * *